US005629683A

United States Patent [19]

Slomowitz et al.

[11] Patent Number: 5,629,683

[45] Date of Patent: May 13, 1997

[54] CRIB GATE POSITION INDICATOR

[76] Inventors: Cynthia J. Slomowitz; Scott M. Slomowitz, both of 2603 Tonbridge Dr., Wilmington, Del. 19810

[21] Appl. No.: 524,006

[22] Filed: Sep. 1, 1995

[51] Int. Cl.[6] ..... G08B 21/00

[52] U.S. Cl. ..... 340/686; 340/539; 340/573; 340/556

[58] Field of Search ..... 340/686, 573, 340/545, 555, 556, 539, 691, 331, 332

[56] References Cited

U.S. PATENT DOCUMENTS 2,734,104 2/1956 Gollhofer ..... 340/686 X
4,231,030 10/1980 Weiss ..... 340/686
4,951,032 8/1990 Langsam ..... 340/686
5,057,819 10/1991 Valenti ..... 340/573
5,291,181 3/1994 De Ponte ..... 340/573

*Primary Examiner*—Thomas Mullen
*Attorney, Agent, or Firm*—Caesar, Rivise, Bernstein, Cohen & Pokotilow, Ltd.

[57] ABSTRACT

A crib gate indicator for use with a baby crib to automatically alert the parent or infant-caretaker when the crib gate has been left in an open condition. A manually-enabled crib gate indicator for accomplishing the same result is also disclosed.

22 Claims, 11 Drawing Sheets

CRIB GATE POSITION INDICATOR

FIELD OF THE INVENTION

This invention relates generally to indicators and, more particularly, to electronic position indicators for the gate of a crib.

BACKGROUND OF THE INVENTION

Most baby cribs comprise a mattress located within a bed frame having four sides, with each side comprising vertical bars positioned between a top molding and a bottom molding. Two opposing sides are vertically displaceable, known as a crib gate, in either a raised (closed) condition or in a lowered (open) position. Lowering the gate is accomplished by displacing a footbar (located at the bottom and just under the bottom molding) which disengages a bottom molding catch from the footbar and then allows the gate to drop downward. Raising the gate is accomplished by simply lifting the gate upwards until the bottom molding catch re-engages the footbar, thereby locking the gate in a raised position.

In most instances, the parent or infant-caretaker will be holding or rocking the baby to sleep. When the parent or infant-caretaker is ready to place the baby on the mattress, the gate is lowered as discussed previously. Usually, the parent or infant caretaker is so focused on positioning the infant on the mattress without waking the infant that frequently the parent or infant-caretaker forgets to raise the gate after the infant is placed on the mattress. The result is that the infant is left in a crib with the gate down. If the infant is old enough to roll and raise himself/herself, the infant could fall out of the crib at a later time because the crib gate remains in an open condition.

Therefore, there remains a need to provide the parent or infant-caretaker with an indication or warning of the crib gate position.

OBJECTS OF THE INVENTION

Accordingly, it is the general object of this invention to provide a crib gate position indicator that overcomes the disadvantages of the prior art.

It is a further object of this invention to provide a crib gate position indicator that immediately informs the parent or infant-caretaker that the crib gate is open.

It is a further object of one aspect of this invention to provide a crib gate position indicator that generates a gate open indication without the need for the parent or infant-caretaker to manually enable/disable some indication apparatus.

It is yet another object of this invention to provide a crib gate position indicator that is easy to install on existing cribs.

It is still a further object of this invention to provide a crib gate position indicator that has no wires within reach of the infant when the infant is in the crib.

SUMMARY OF THE INVENTION

These and other objects of the instant invention are achieved by providing an apparatus for use with a baby crib having a displaceable gate that can be positioned in an open condition or in a closed condition. The apparatus provides an automatic indication to a person (e.g., parent or infant caretaker) of the condition of the gate.

DESCRIPTION OF THE DRAWINGS

Other objects and many of the attendant advantages of this invention will be readily appreciated as the same becomes better understood by reference to the following detailed description when considered in connection with the accompanying drawings wherein.

DESCRIPTION OF THE PREFERRED EMBODIMENT OF THE INVENTION

Figure 2:
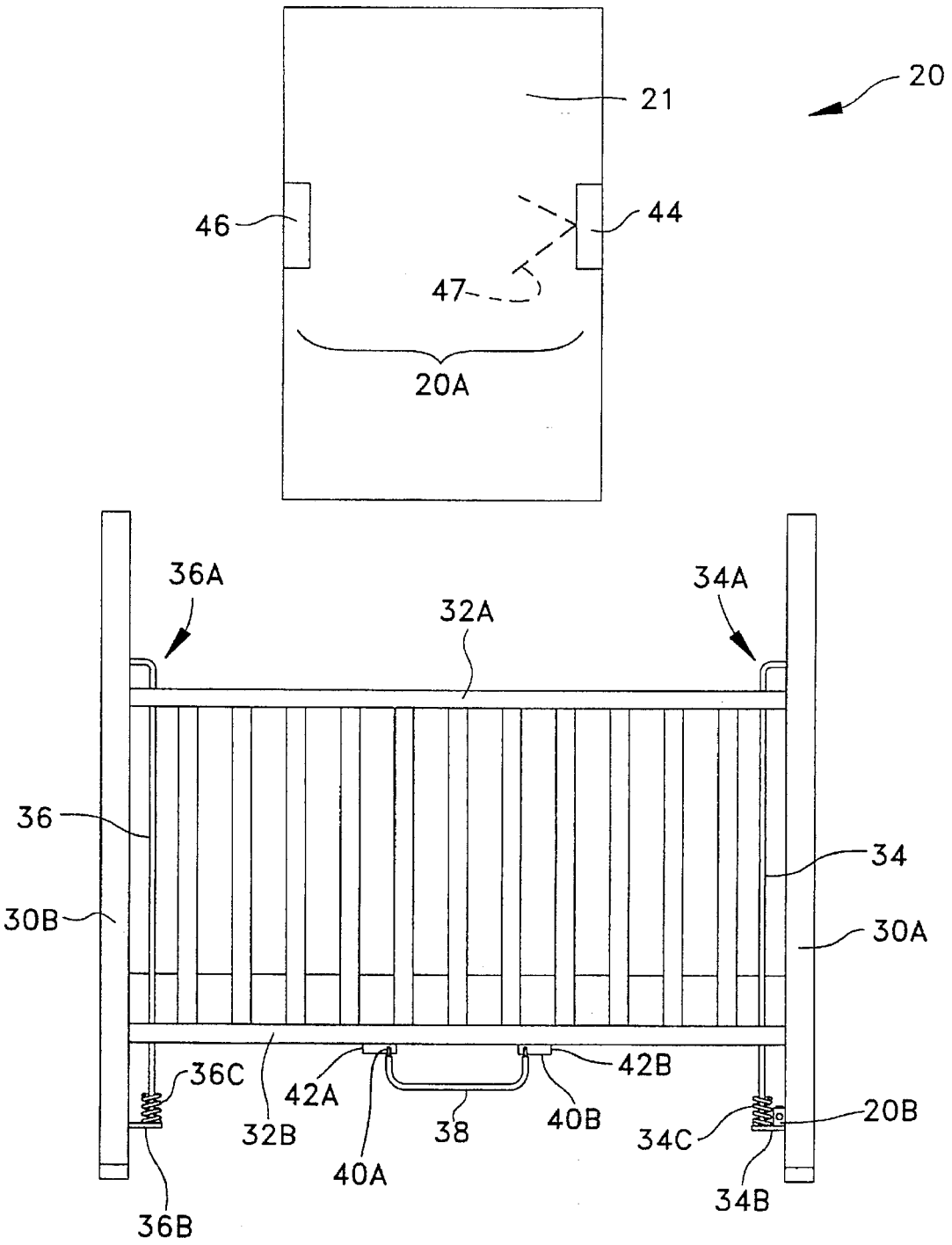
FIG. 2 is a side view of the crib with the gate sensor means coupled thereto and a view of the doorway with the enabling means coupled thereto.

Referring now in greater detail to the various figures of the drawing wherein like reference characters refer to like parts, there is shown generally at 20 in FIG. 2 a crib gate position indicator constructed in accordance with this invention. The crib gate position indicator 20 comprises an enabling means 20A, arranged to be disposed near the doorway 21 of the room containing a conventional baby crib 22, and a gate sensor means 20B coupled to the crib 22.

Before a description of the crib gate position indicator 20 is discussed, an overview of the conventional baby crib 22 (FIG. 1) will be discussed. The crib 22 being of conventional construction (e.g., a Simmons "Cabri" crib) is arranged to support a mattress 24 which is positioned within a crib frame. The frame comprises four sides wherein two opposing sides 26 and 28 each form a crib gate. The crib 22 rests on the floor by way of four legs 30A–30D. Typically, the crib 22 is located in the infant's room such that only one of the two opposing crib gates 26 or 28 is used, e.g., one of the crib gates is positioned close to the wall and is therefore not used. As such, the gate sensor means 20B can be located to operate regardless of which crib gate 26 or 28 is to be active. For simplicity, the operation of the gate sensor means 20B will be discussed with respect to only one crib gate, it being understood that the operation of the gate sensor means 20B with the other opposing gate is similar.

As can be seen more clearly in FIG. 2, the crib gate 26 comprises a upper molding 32A and a lower molding 32B. The moldings have respective holes (not shown) that align to allow the crib gate 26 to be vertically displaceable along a first slide rod 34 and a second slide rod 36. The slide rods 34 and 36 are fixedly secured to crib legs 30A and 30B at their respective top ends 34A and 36A. In addition, the slide rods 34 and 36 are fixedly secured to crib legs 30A and 30B at their respective bottom ends by respective support plates 34B and 36B. To cushion the weight of the gate 26 when the gate is down (as will be discussed later), the lower molding 32B rests on a pair of support springs 34C and 36C.

Figure 1:
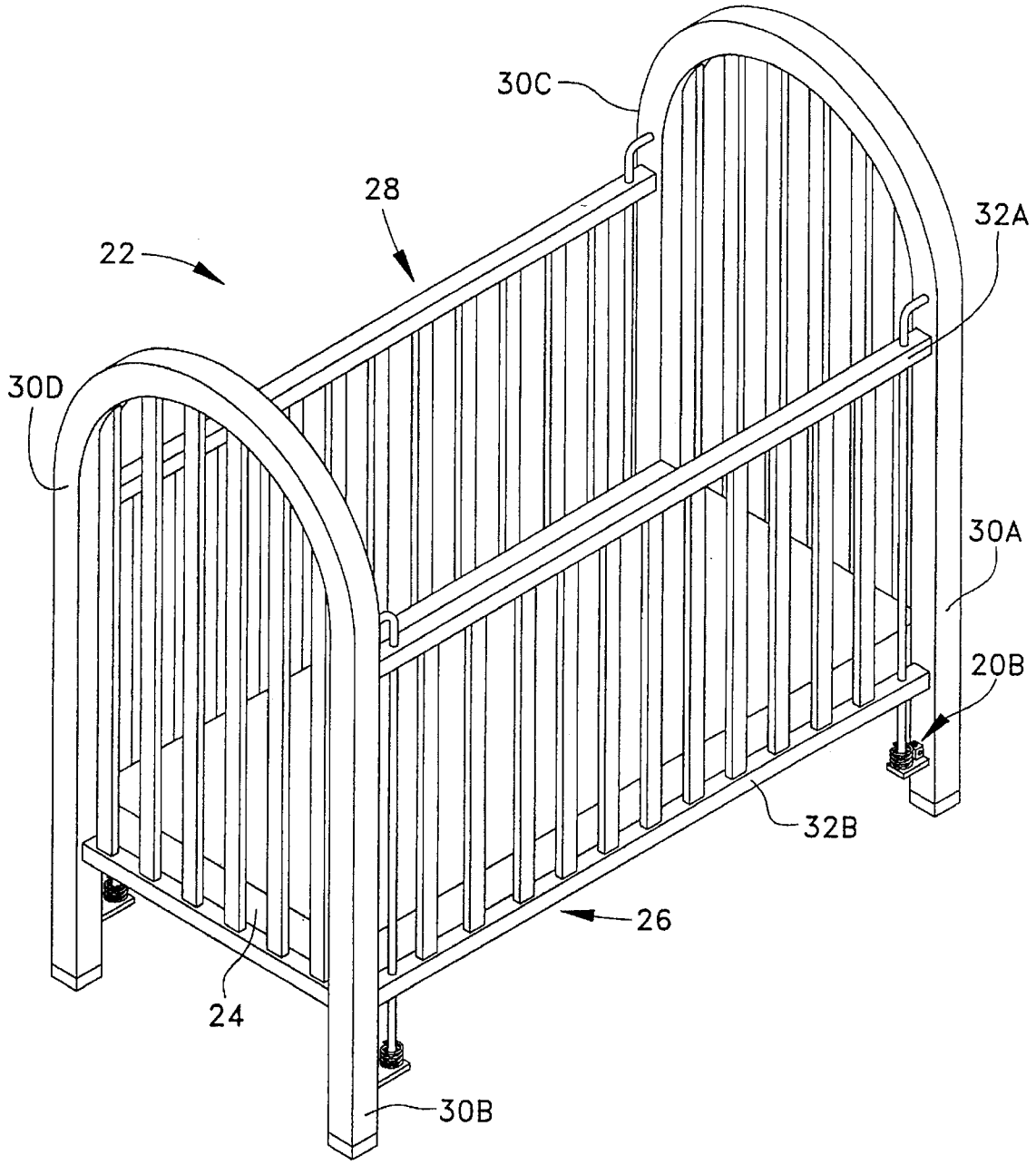
FIG. 1 is an isometric view of a conventional crib with the gate sensor means, constructed in accordance with this invention, coupled thereto.

The crib gate 26 is designed to be in either one of two states: an open (gate-down) condition or a closed (gate-up) condition. FIGS. 1 and 2 show the crib gate 26 in a closed (gate-up) condition. Coupled to the underside of the mattress support is a pivoting footbar 38. The footbar 38 is pivotally coupled to the mattress support and is spring-loaded such that whenever there is no countering force by the parent's or infant caretaker's foot, two prongs 40A and 40B, located on the footbar 38, are positioned in the plane of vertical displacement of the gate 26. These prongs 40A and 40B engage two corresponding catch plates 42A and 42B positioned on the bottom surface of the lower molding 32B. Hence, when these prongs 40A and 40B engage the corresponding catches 42A and 42B, the crib gate 26 is in the closed (gate-up) position. To open the gate, the parent or infant-caretaker pivots the footbar 38 by pushing the footbar 38 towards the center of the crib 22 (into the plane of FIG. 2), thereby disengaging the prongs 40A and 40B from the corresponding catches 42A and 42B. Such disengagement allows the crib gate 26 to drop down. In this position, the bottom surface of the lower molding 32B rests on cushioning springs 34C and 36C. To close the gate, the parent or infant-caretaker simply pulls the upper molding 32A upward until the corresponding catches 42A and 42B re-engage the prongs 40A and 40B on the footbar 38, thereby locking the crib gate 26 in a closed (gate-up) condition.

As stated earlier, the crib gate position indicator 20 comprises an enabling means 20A and a gate sensor means 20B. These means work in cooperation with each other to automatically alert the parent or infant-caretaker when the crib gate 26 is in the open (gate-down) condition.

Figure 3:
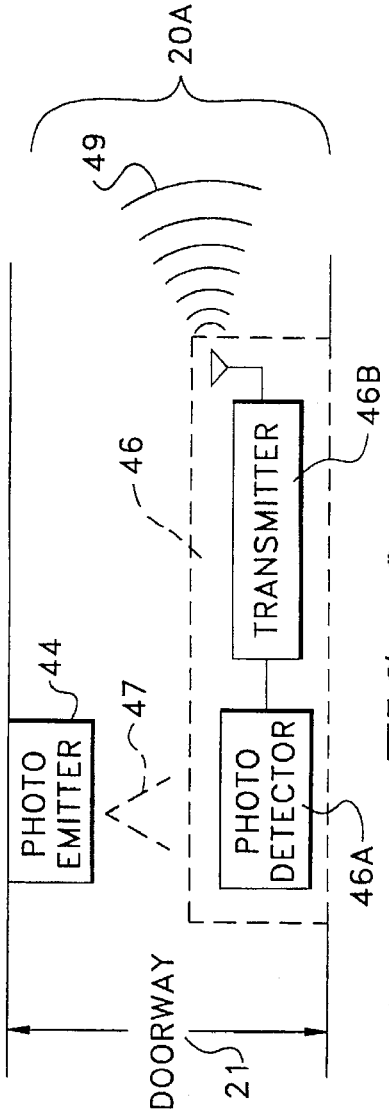
FIG. 3 is a top view of the doorway of FIG. 2 showing a block diagram/schematic of the enabling means.

As shown in FIG. 3, the enabling means 20A comprises a photo-emitter 44 (e.g., an infrared light source) and a detector unit 46. The detector unit 46 comprises a photodetector 46A and a transmitter 46B. The photo-emitter 44 and the detector unit 46 are mounted on opposite sides of the doorway 21 (to the room containing the crib 22) such that a light beam 47 generated by the photo-emitter 44 impinges the photodetector 46A. This photoemitter 44/photodetector 46A can be implemented using an OMRON® EE-SPW401 phototransmitter/photoreceiver.

Whenever someone passes through the doorway 21, the photodetector 46A detects the movement (due to interruption of a light beam 47 across the doorway 21) and activates the transmitter 46B. The transmitter 46B then generates a signal 49. As will be discussed in detail later, the gate sensor means 20B includes a receiver 48 for receiving the transmitted signal 49 from the transmitter 46B. The transmitter 46B/receiver 48 (e.g., Linear Alert Receiver Model No. D-8C and associated transmitter) operate on one of the frequencies provided for the local transmission of coded information such as those employed with garage door openers, and the like. It is also contemplated by the applicants that the transmitter 46B/receiver 48 portion will include logic for appending additional changeable coded information on the signal sent between them which can be employed to prevent interference between the use of the transmitter 46B and baby monitors, garage door openers, etc. in the area which might be affected thereby, and vice versa. Power for the enabling means 20A can be provided by a battery (not shown) or AC power from a wall socket (not shown).

Figure 4:
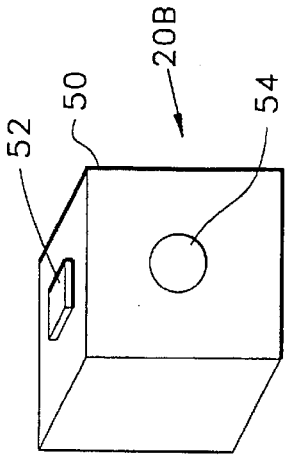
FIG. 4 is an enlarged isometric view of the gate sensor means shown in FIG. 1.

As shown in FIG. 4, the gate sensor means 20B comprises a housing 50 having a crib gate switching means 52 (e.g., a C&K® 8168J81ZGE22 SPDT switch or proximity switch) located on the top surface of the housing 50 and an indication means 54 (e.g., a light emitting diode-Panasonic LN28RP, a light bulb or any type of illuminator) disposed on a side of the housing 50. The bottom surface of the housing 50 includes a fastening means (e.g., a Velcro fastening tape, magnet, screw, clasp, etc.) for securement of the housing 50 to one of the support plates 34B or 36B. The housing 50 is mounted by the user on one of the support plates 34B or 36B (on the gate 26 or 28 that is normally used) such that the indication means 54 is facing outward, being visible to the parent or infant-caretaker, as shown in FIG. 1. Activation of the crib gate switching means 52 is caused by the lower molding 32B of the crib gate 26 depressing the switching means 52 when the gate 26 is in the "down" (open) condition. Conversely, raising (closing) the gate 26 de-activates the crib gate switching means 52.

The indication means 54 provides an indication to the parent or infant-caretaker that the crib gate 26 has been lowered. In addition, as will be discussed in detail later, operation of the indication means 54 takes into account that the parent or infant-caretaker may be removing the infant from the crib 22 in the morning or after a nap when the gate 26 is preferably left in a lowered condition. In those circumstances, the indication means 54 provides a predetermined period (e.g., 30 minutes) of indication to the parent or infant caretaker. In all circumstances, the indication means 54 is designed to activate automatically, while keeping power requirements of the gate sensor means 20B to a minimum.

Figure 5:
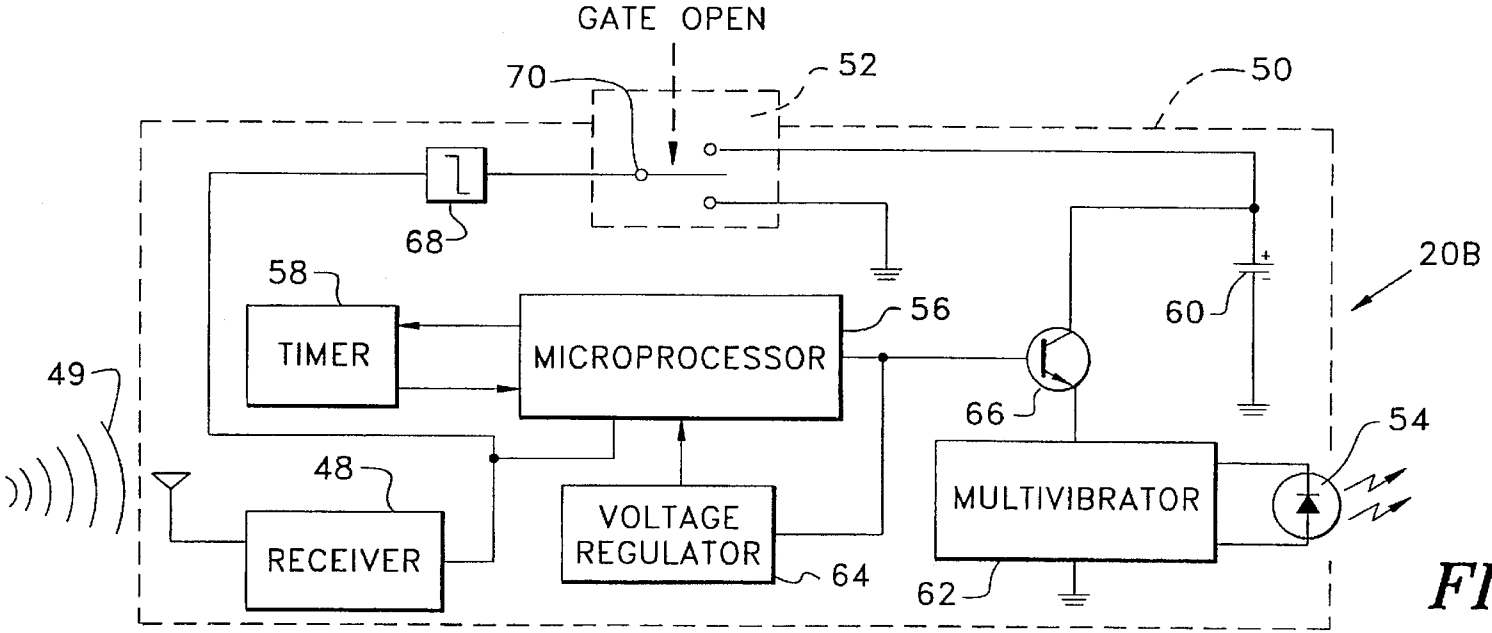
FIG. 5 is a block diagram of the gate sensor means.
Figure 6:
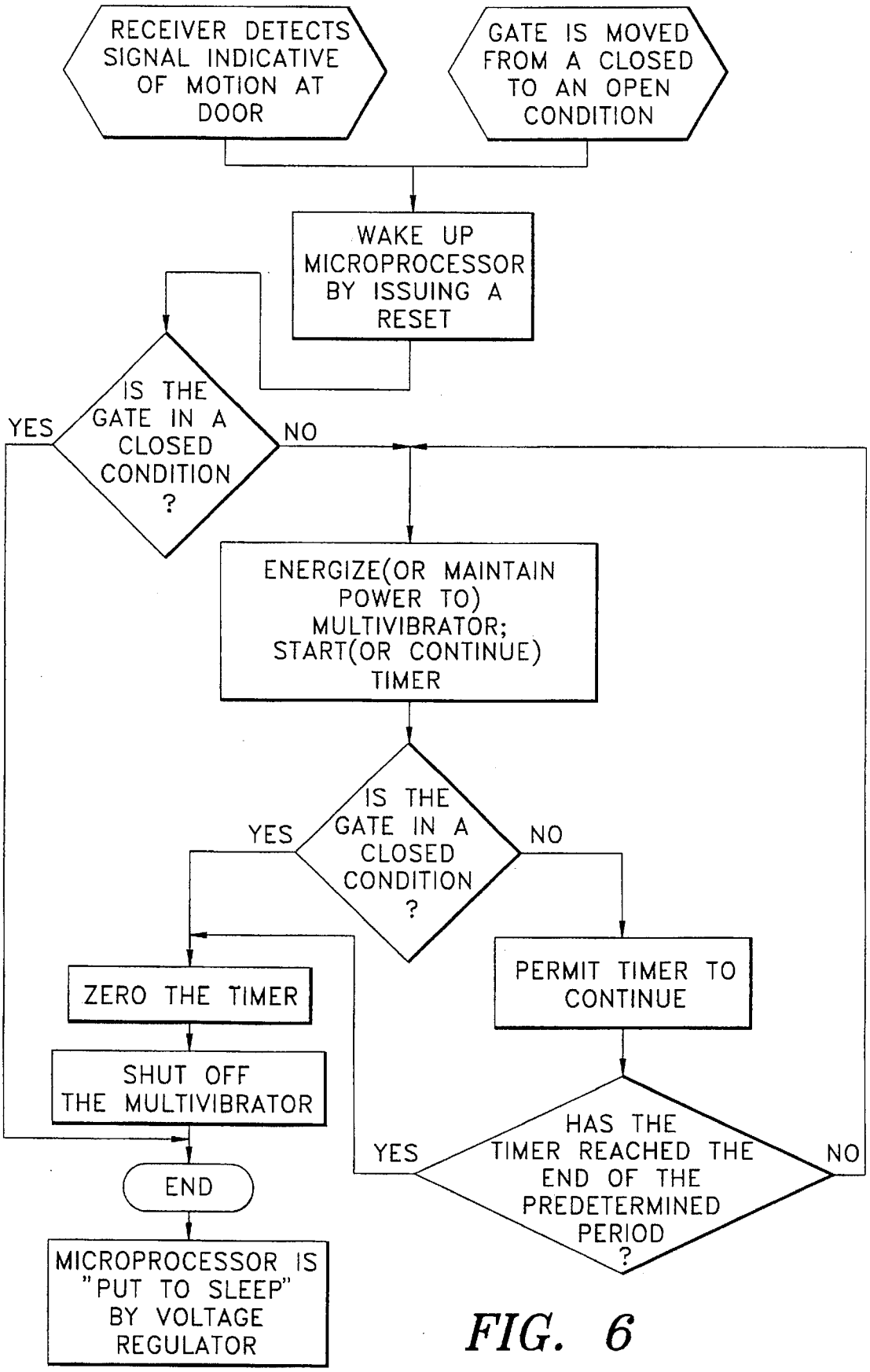
FIG. 6 is a flow chart showing the operation of the first embodiment of the subject invention and which operation is accomplished under the control of a microprocessor with suitable software.

As shown in FIG. 5, the gate sensor means 20B further comprises the receiver 48, a microprocessor 56, a timer 58, a battery 60, a multivibrator 62, a voltage regulator 64, a transistor 66 and a falling-edge detector 68. The battery 60 provides the necessary voltages/currents for the receiver 50, microprocessor 56, timer 58, multivibrator 62, voltage regulator 64, transistor 66 and falling-edge detector 68 operation. Once powered, the microprocessor 56 implements the program shown in FIG. 6.

In particular, when the parent or infant-caretaker enters the room, the enabling means 20A is activated and the transmitter 46B transmits a signal that is received by the receiver 48. Upon receipt of this signal, the receiver 48 resets the microprocessor 56 (e.g., an NEC UPD70108C8) thereby enabling the gate sensor means 20B. The microprocessor 56 checks the state of the crib gate switching means 52 to see whether the gate 26 is up or down. If the gate 26 is down (indicated to the microprocessor 56 by a ground voltage, as shown in FIG. 5), the microprocessor 56 turns on the transistor 66 (e.g., National Semiconductor PN5133-ND) which permits the multivibrator 62 to be energized. The multivibrator 62 (e.g., National Semiconductor CD4047BCM-ND) causes the indication means 54 to flash. The microprocessor 56 then continues to monitor the gate 26 position for a predetermined period (e.g., 30 minutes). If the gate 26 is not closed within that period, it is assumed that the infant is being removed from the crib 22 for a long duration (e.g., upon awaking from a night's sleep or a nap) and, as such, the indication means 54 will shut off; otherwise, the indication means 54 will continue to flash until the gate 26 is closed or until the end of the predetermined period has been reached, as is discussed below. The length of the predetermined period accounts for the situation where the parent or infant-caretaker has entered the room, dropped the gate 26 but must still rock the infant into a full sleep before placing the infant in the crib 22.

If the gate 26 is closed within that period, the microprocessor 56 detects the closure from the crib gate switching means 52 (indicated to the microprocessor by a battery voltage, as shown in FIG. 5), sets the timer 58 (e.g., a National Semiconductor COP498N-ND Low Power CMOS Ram and Timer) back to zero and then shuts off the transistor 66 which shuts off the multivibrator 62 and the indication means 54. At the same time that the microprocessor 56 shuts off the transistor 66, the voltage regulator 64 (e.g., Cherry Semiconductor Smart Regulator™ CS-8147) detects the shut-off of the transistor 66 and therefore puts the microprocessor 56 "to sleep" in a low power state, thereby reducing the power requirements. The microprocessor 56 then awaits either another reset from the enabling means 20A or from the gate 26 being opened again.

Since entry to, or exit from, the room causes the enabling means 20A to reset the microprocessor 56 each time, nuisance activation of the gate sensor means 20B can be avoided by the parent or infant-caretaker closing the gate 26 after the infant is removed from the crib 22. In that situation, although any subsequent entry and exit from the room resets the microprocessor 56, the gate indication means 20B remains in an off condition due the gate 26 being in the closed state. In the situation where the parent or infant-caretaker removes the infant from the crib 22, leaves the gate 26 in an open position (gate down) and exits the room, the enable means 20A will enable the gate sensor means 20B whereby the gate sensor means 20B will then flash for the predetermined period and will then shut-off.

If the crib gate 26 is already in a closed condition when the parent or infant-caretaker enters the room with the sleeping infant, the lowering of the crib gate 26 resets the microprocessor 56. In particular, once the parent or infant-caretaker enters the room with the infant, the enabling means 20A resets the microprocessor 56; however, since the gate 26 is closed, the microprocessor 56 zeroes the timer 58, keeps the multivibrator 62 off and is "put to sleep" by the voltage regulator 64. As soon as the parent or infant-caretaker opens the gate 26, the crib gate switching means 52 generates a "falling edge" voltage (e.g., battery 60 voltage is switched to ground at the crib gate switch pole 70) which is detected by the falling edge detector 68. This falling edge detector 68 (e.g., National Semiconductor DM74AS74SN-ND Edge Triggered Flip-Flop) then generates a reset signal to the microprocessor 56 to "wake up" the microprocessor 56. Once this occurs, operation of the gate indication means 20B is similar to the process discussed previously with regard to the receiver 48 causing a microprocessor 56 reset. It should be noted that the falling edge detector 68 also includes any debouncing circuitry to prevent the falling edge detector 68 from issuing a series of reset signals due to crib gate switching means 52 bouncing.

In FIGS. 7–10, there is shown a second embodiment of the crib gate position indicator which comprises an enabling means 120A and a gate sensor means 120B. As will be discussed in detail later, the important difference between the first embodiment and the second embodiment is that the location of the indication means 54 is in the enabling means 120A (FIG. 7) rather than in the gate sensor means 120B. It should be understood that the enabling means 120A and gate sensor means 120B are installed in the same manner with respect to the doorway 21 and crib 22 as discussed with the first embodiment. As such, with the second embodiment installed, the parent or infant-caretaker is alerted of a "gate open" indication at the doorway 21, rather than at the crib 22 as in the first embodiment.

Figure 7:
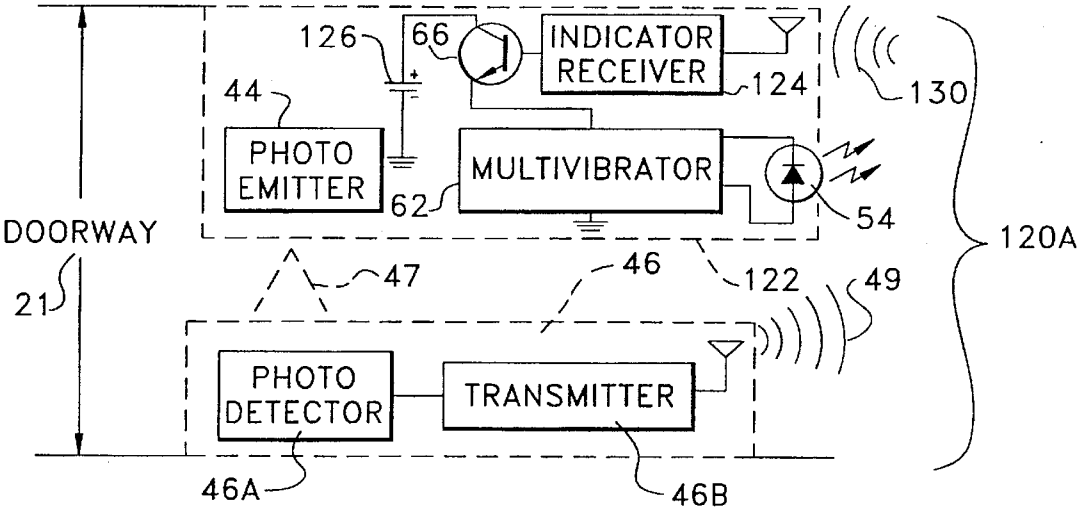
FIG. 7 is a diagram similar to FIG. 3 of a second embodiment of the subject invention.

In particular, as shown in FIG. 7, the photoemitter 44 now resides inside a housing 122 that also contains the indication means 54, an indicator receiver 124, a battery 126, the transistor 66, and the multivibrator 62. Power for the enabling means 120A can be provided by the battery 126 or AC power from a wall socket (not shown).

Figure 8:
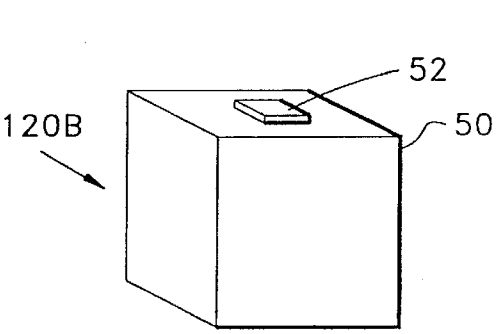
FIG. 8 is a view similar to FIG. 4 but showing the gate sensor means of the second embodiment of the subject invention.
Figure 9:
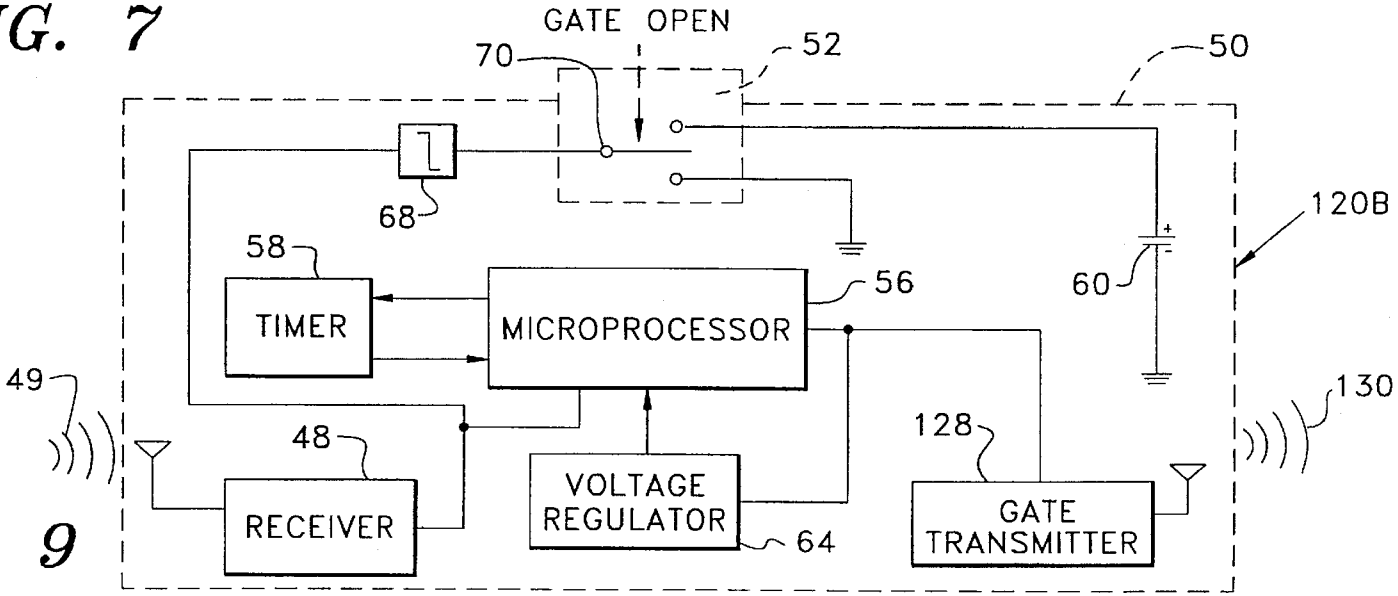
FIG. 9 is a block diagram of the gate sensor means of the second embodiment of the subject invention.
Figure 10:
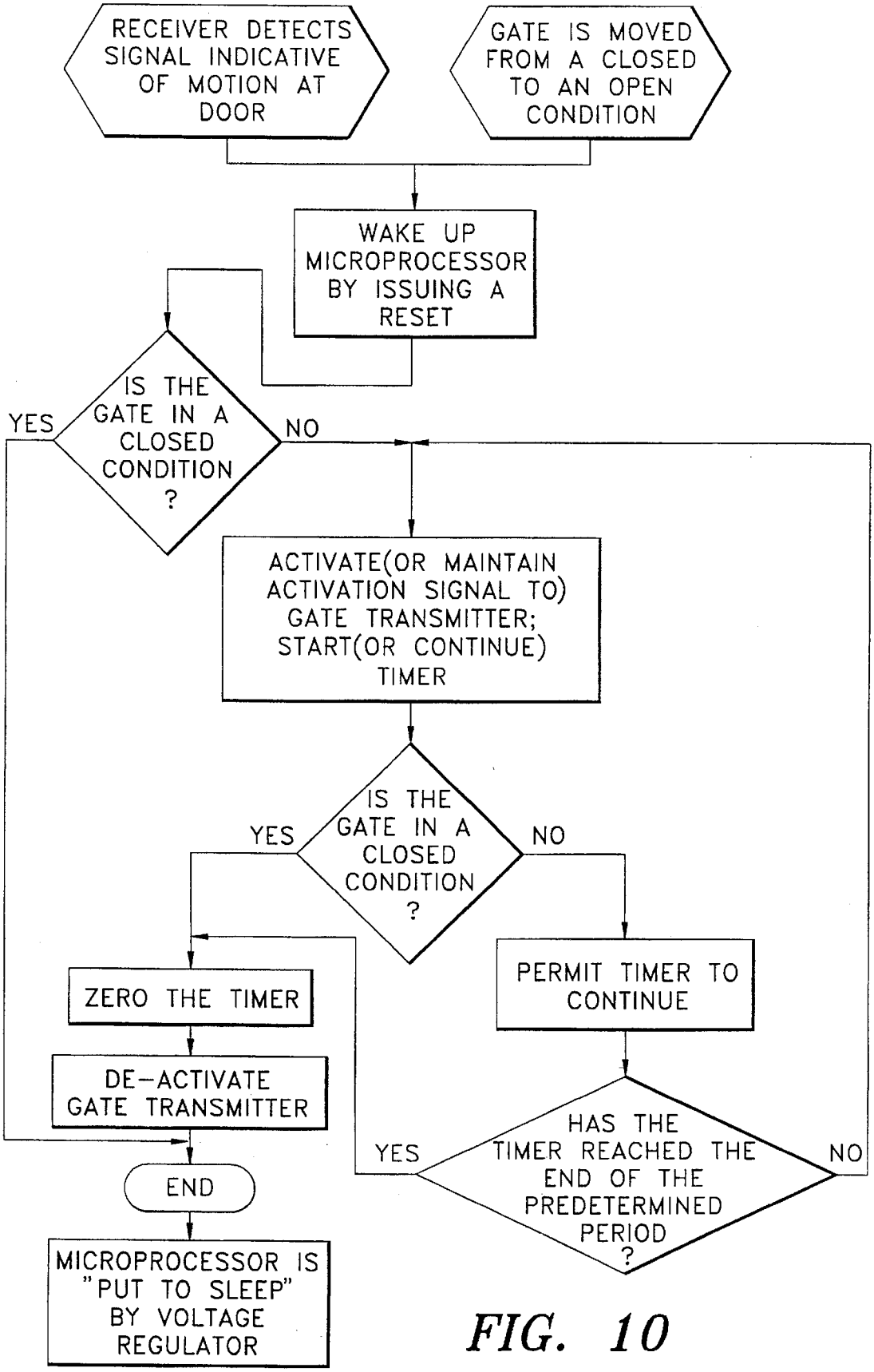
FIG. 10 is a flow chart similar to FIG. 6 but showing the operation of the second embodiment of the subject invention.

In addition, as shown in FIGS. 8 and 9, the indication means 54 has been removed from the gate sensor means 120B. A gate transmitter 128 is included in the gate sensor means 20B.

Operation of the second embodiment is as follows. The enabling means 120A is activated in the same manner as the enabling means 20A such that when a parent or infant-caretaker enters the room, the enabling means 120A enables the gate sensor means 120B. Once powered, the microprocessor 56 implements the program shown in FIG. 10. In particular, the microprocessor 56, instead of turning on/off the transistor 66 as in the first embodiment, controls the activation of the gate transmitter 128. The gate transmitter 128, when activated by the microprocessor 56, emits a signal 130 that is received by the indicator receiver 124 at the doorway 21 in the housing 122. The indicator receiver 124 turns on the transistor 66 which permits the multivibrator 62 to be energized and the indication means 54 begins flashing, as discussed previously with respect to the first embodiment. If either the crib gate 26 is closed or if the timer 58 reaches the predetermined period before the crib gate 26 is closed, the microprocessor 56 de-activates the gate transmitter 128. When the gate transmitter 128 is deactivated, the indicator receiver 124 no longer receives the signal 130 and therefore turns off the transistor 66, thereby shutting off the indication means The gate transmitter 128/indicator receiver 124 (e.g., Linear Alert Receiver Model No. D-8C and associated transmitter) operate on one of the frequencies provided for the local transmission of coded information such as employed with garage door openers, and the like. It is also contemplated by the applicants that the gate transmitter 128/indicator receiver 124 portion will include logic for appending additional changeable coded information on the signal sent between them which can be employed to prevent interference between the use of the gate transmitter 128 and the transmitter 46B/receiver 48, as well as between any baby monitors, garage door openers, etc. in the area which might be affected thereby, and vice versa.

Figure 11:
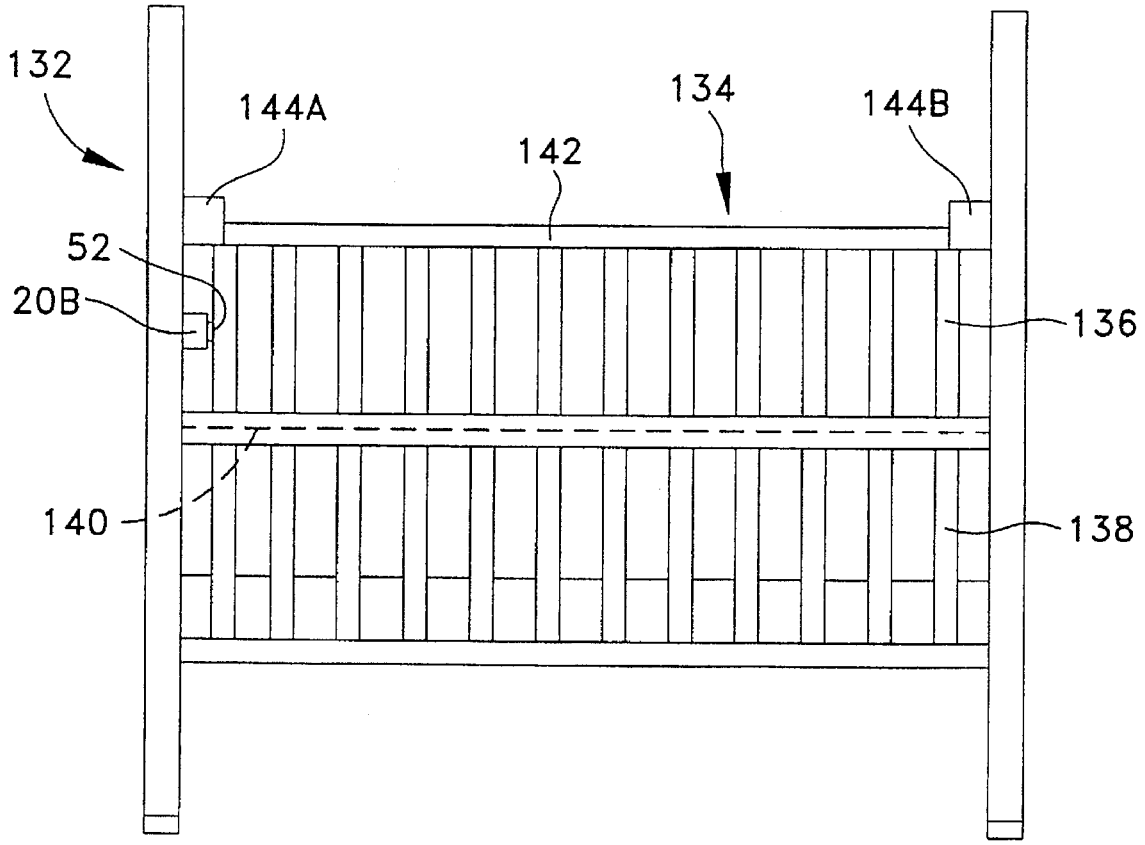
FIG. 11 is an isometric view of another conventional crib having a rotating gate having a gate sensor means, constructed in accordance with this invention.

It should be noted that is also within the broadest aspect of this invention to have the gate sensor means 20B or 120B be compatible with a variety of displaceable gate cribs. For example, there is shown in FIG. 11 a Gerry Wood Products, Inc. Model 85 crib 132 having a crib gate 134 that has a rotatable upper portion 136 and fixed lower portion 138. In particular, the upper portion 136 rotates about an axis 140 towards the crib interior (into the plane of the paper in FIG. 11), thereby opening the gate 134. The ends of the upper molding 142 are releasably press-fit into catches 144A and 144B by the parent or infant-caretaker to close the gate 134. Pressure on the upper molding 142 towards the crib interior disengages the ends of the upper molding 142 from the catches 144A and 144B, thereby opening the gate 134. FIG. 11 depicts the crib gate 134 in a closed condition.

The gate sensor means 20B or 120B can be coupled to the crib 132 to detect the "open" or "closed" condition of the upper portion 136. For example, as shown in FIG. 11, the gate sensor means 20B or 120B can be mounted to one of the legs of the crib 132 such that the crib gate switching means 52 is depressed whenever the gate 134 is closed. As such, two modifications to the gate sensor means 20B (or 120B) would be necessary. The software in the microprocessor 56 would be modified to treat a ground voltage (crib gate switching means 52 depressed) as an indication of a "gate closed" condition while a battery voltage (crib gate switching means 52 not depressed) as an indication of a "gate open" condition. In addition, the falling edge detector 68 would be replaced with a rising edge detector since the act of opening the gate 134 would cause a ground voltage to change to a battery voltage at the crib gate switch pole 70. It should be noted that alternate mounting locations of the gate sensor means 20B (or 120B) to the crib 132 could be achieved such that the crib gate switching means 52 interacts with movement of the crib gate 134 in accordance with FIGS. 5 (for gate sensor means 20B) and 9 (for gate sensor means 120B) without the need to make the above two modifications.

All of the above disclosure concerns apparatus for the automatic indication of a crib gate position to the parent or infant-caretaker without the need for the parent or infant-caretaker to intervene (e.g., press a switch) other than to open or close the crib gate 26, as he/she would do in the usual circumstances.

Figure 13:
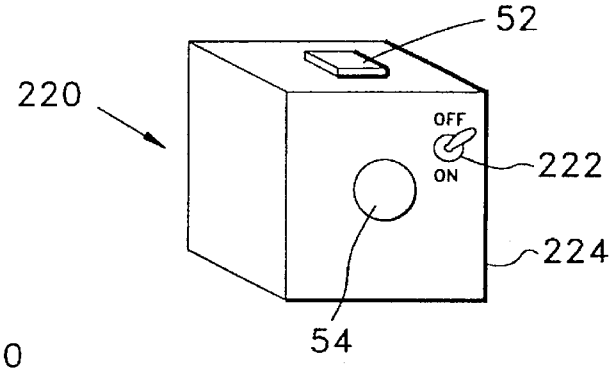
FIG. 13 is enlarged isometric view of the manually-operated crib gate sensor means of FIG. 12.
Figure 12:
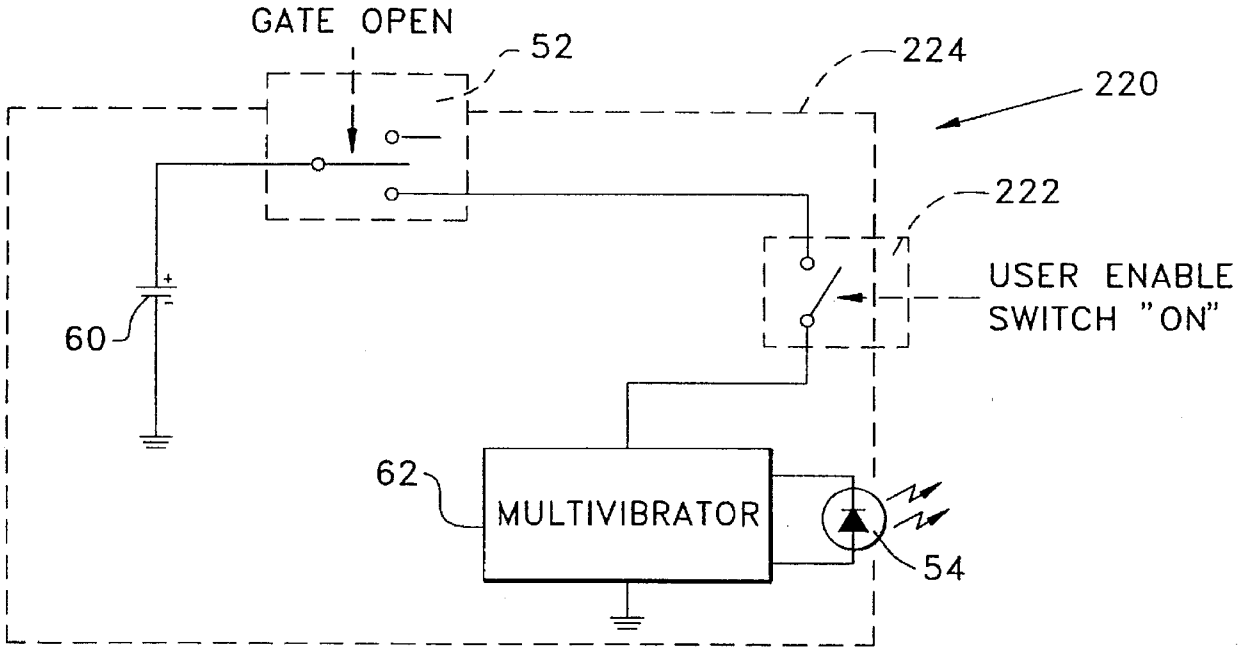
FIG. 12 is a schematic diagram of a manually-operated crib gate sensor means.

There is disclosed in FIGS. 12 and 13 a manually-operated gate sensor means 220 which can be coupled to any conventional crib e.g., crib 22 or crib 132). FIG. 12 shows the circuit for this manually-operated gate sensor means 220 which comprises the crib gate switching means 52, the indication means 54, the battery 60, the multivibrator 62, and a manual user enable switch 222 (e.g., a C&K® 7101SYCBE-toggle). Operation of the manually-operated sensor 220 is as follows. The parent or infant-caretaker must ensure that the manual user enable switch 222 is in the "on" condition. This ensures that the only condition necessary for activation of the indication means 54 is the closure of the crib gate switching means 52. Therefore, if the parent or infant-caretaker comes to remove the infant from the crib 22 in the morning, the parent or infant-caretaker would drop the gate 26, thereby activating the indication means 54. The parent or infant-caretaker would then either close the gate 26 or shut off the manual user enable switch 222, or both. Failure to do either one of these will cause the indication means 54 to continue to flash and eventually deplete the battery 60. If the parent or infant-caretaker shuts off the manual user enable switch 222, but does not close the gate 26, then the parent or infant-caretaker must remember to turn the manual user enable switch 222 "on" when placing the infant back in the crib 22. Failure to do that will not enable the indication means 54, thereby defeating the purpose of the invention. Finally, the parent or infant-caretaker may leave the manual user enable switch 222 in the "on" condition, but must remember to close the gate 26 upon removing the infant or else the indication means 54 will continue to flash.

The manually-operated gate sensor means 220 comprises a housing 224 similar to that of the gate sensor 20B. The manual user enable switch 222 has a toggle lever arm that allows the parent or infant-caretaker to activate the switch 222.

It should further be noted that it is within the broadest scope of this invention to have the gate sensor means 20B, 120B or 220 be an integral portion of the crib, i.e., the crib gate switching means 52 and the associated circuitry (and the indication means 54 with regard to the gate sensor means 20B and 220) can be built into the crib frame rather than being contained within a housing that is affixed to some portion of the crib as described herein. However, the preferred embodiment comprises a housing to allow application of this invention to existing cribs.

Figure 14:
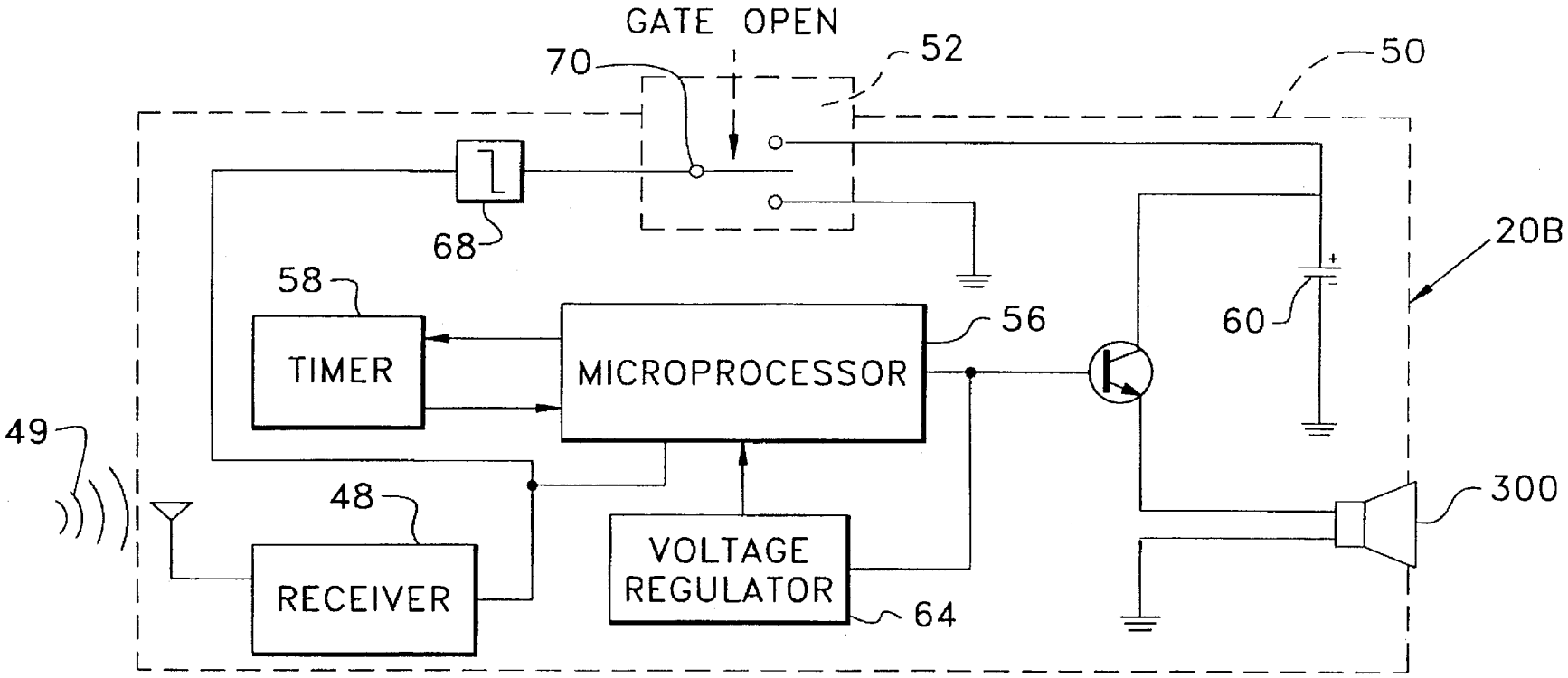
FIG. 14 is similar to FIG. 5 but with the multivibrator and the illuminator replaced with an annunciator.
Figure 15:
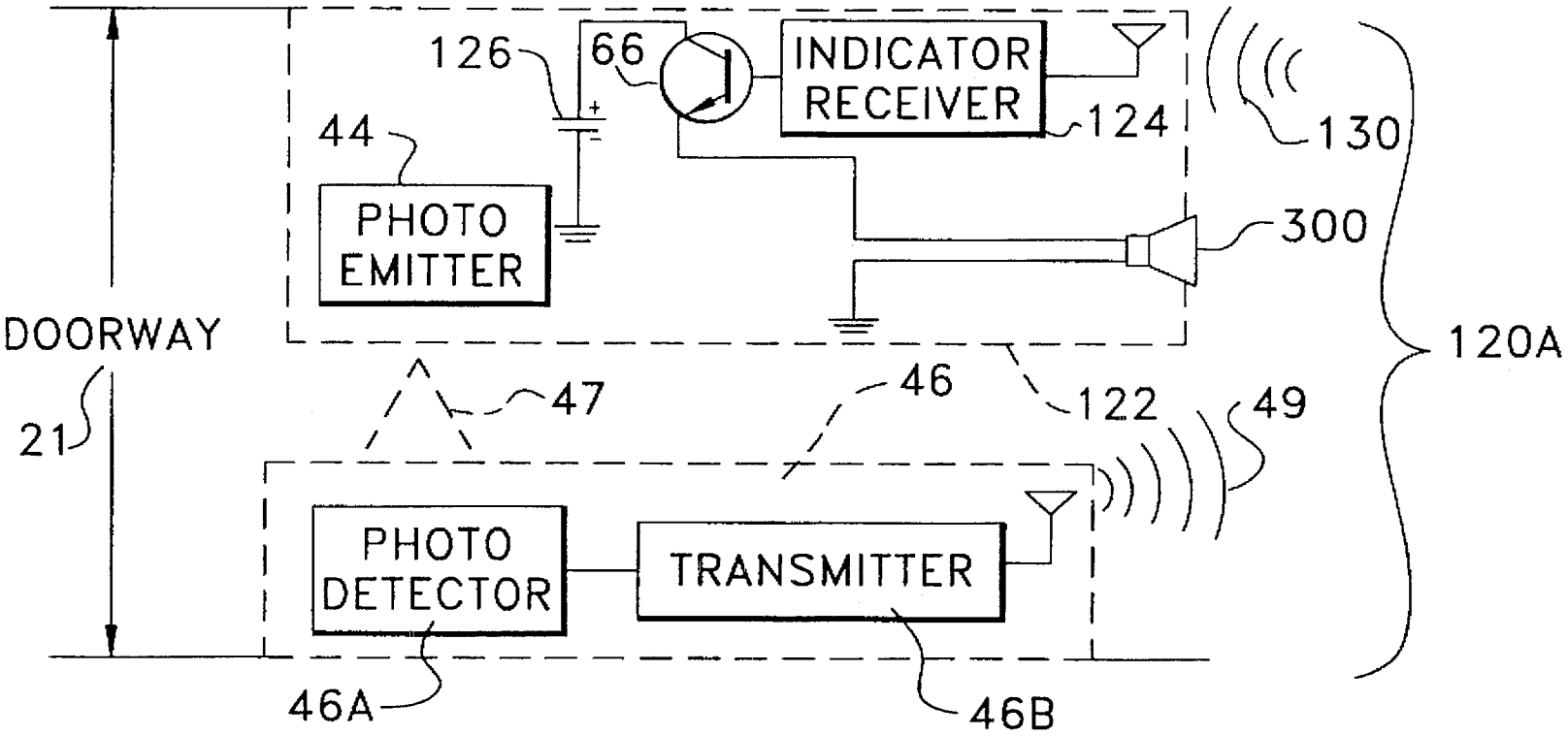
FIG. 15 is similar to FIG. 7 but with the multivibrator and the illuminator replaced with an annunciator.
Figure 16:
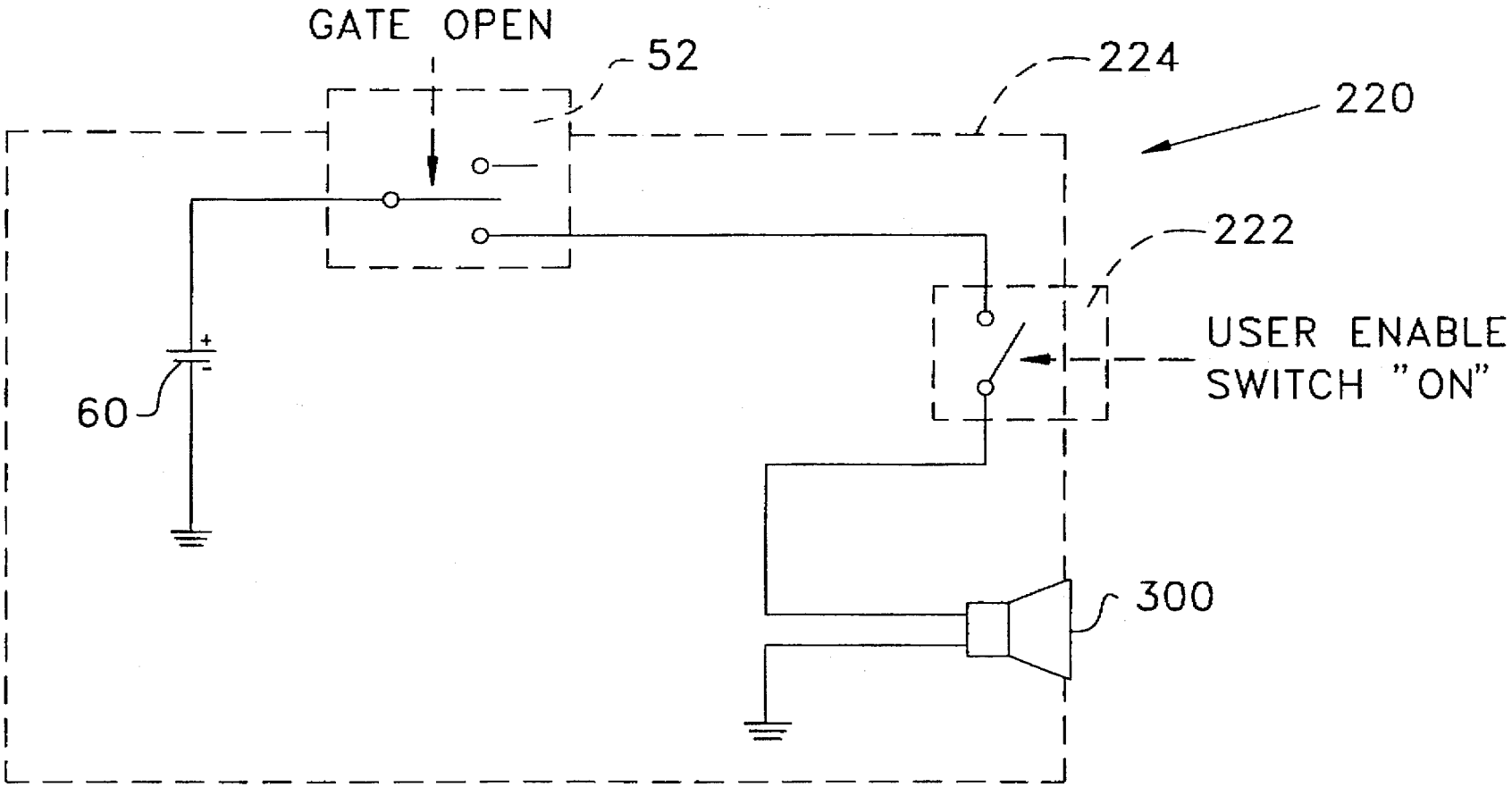
FIG. 16 is similar to FIG. 12 but with the multivibrator and the illuminator replaced with an annunciator.

It should also be noted that the multivibrator 62 and the indication means 54 of the gate sensor means 20B and 220 and the enabling means 120A can be replaced with a low volume annunciator 300 (e.g., Panasonic EFB-CB37C11 Ceramic Buzzer) for providing an audible indication to the parent or infant-caretaker that the gate 26 has been left in an open condition (FIGS. 14–16). The use of a low volume annunciator 300 assures that the infant will not be awakened by the audible sound, while providing the "open gate condition" alert to the parent or infant-caretaker. Activation of the annunciator 300 would be similar to activation of the multivibrator 62 and indication means 54 described above.

Without further elaboration, the foregoing will so fully illustrate our invention that others may, by applying current or future knowledge, readily adopt the same for use under various conditions of service.

We claim:

1. An apparatus for use with a baby crib having a displaceable gate that can be positioned in an open condition or in a closed condition, said apparatus providing an automatic, remotely-located indication of the condition of the gate, said apparatus comprising:

gate sensor means, coupled to the crib, including a transmitter for wirelessly transmitting a gate indication signal representative of the open condition of the gate;

a remotely-located receiver including an indication means, said remotely-located receiver receiving said gate indication signal and said gate indication signal controlling the activation of said indication means; and remotely-located enabling means, said enabling means enabling said gate sensor means whenever a person moves into the vicinity of the crib.

2. The apparatus of claim 1 wherein said indication means comprises an illuminator.

3. The apparatus of claim 1 wherein said indication means comprises an annunciator.

4. The apparatus of claim 1 wherein said remotely-located enabling means includes said receiver and said indication means.

5. An apparatus for use With a baby crib having a displaceable gate that can be positioned in an open condition or in a closed condition, said apparatus providing an automatic indication to a person of the condition of the gate, said apparatus comprising a remotely-located enabling means and a gate sensor means coupled to the crib, said enabling means enabling said gate sensor means whenever the person moves into the vicinity of the crib.

6. The apparatus of claim 5 wherein said enabling means comprises a first transmitter and said gate sensor means comprises a first receiver, said first transmitter transmitting a first signal over the air for receipt by said first receiver.

7. The apparatus of claim 6 wherein said enabling means further comprises a photoemitter/photodetector for detecting the presence of the person in the vicinity of said enabling means and for causing said transmitter to transmit said first signal.

8. The apparatus of claim 7 wherein said gate sensor means comprises a microprocessor, said first receiver resetting said microprocessor whenever said first receiver receives said first signal from said first transmitter.

9. The apparatus of claim 8 wherein said gate sensor means further comprises a switch means for detecting the open or closed condition of the gate.

10. The apparatus of claim 9 wherein said switch means informs said microprocessor of the condition of the gate, said microprocessor controlling an indication means based on the condition of the gate.

11. The apparatus of claim 10 wherein said gate sensor means further comprises a timer, said timer permitting said indication means to alert the person for a predetermined period of time.

12. The apparatus of claim 11 wherein said timer is reset by said microprocessor whenever the gate is closed or said predetermined period of time is reached by said timer.

13. The apparatus of claim 12 wherein said gate sensor means comprises a voltage regulator that reduces the power requirements of said microprocessor whenever said gate is closed or said predetermined period of time is reached.

14. The apparatus of claim 13 wherein said gate sensor means further comprises said indication means.

15. The apparatus of claim 13 wherein said enabling means further comprises said indication means.

16. The apparatus of claim 15 wherein said gate sensor means further comprises a second transmitter and said enabling means further comprises a second receiver, said second transmitter transmitting a second signal over the air for receipt by said second receiver.

17. The apparatus of claim 16 wherein said microprocessor activates said second transmitter for transmitting said second signal, said microprocessor activating said second transmitter to transmit said second signal based on the condition of the gate.

18. The apparatus of claim 17 wherein said second receiver energizes said indication means whenever said second signal is received by said second receiver.

19. The apparatus of claim 18 wherein said switch means resets said microprocessor whenever the gate is positioned from a closed condition to an open condition.

20. The apparatus of claim 9 wherein said indication means alerts the person that the gate is in an open condition.

21. An apparatus for use with a baby crib having a displaceable gate that can be positioned in an open condition or in a closed condition wherein said apparatus provides an automatic indication to a person of the condition of the gate, said apparatus comprising:

a remotely-located enabling means and a gate sensor means coupled to the crib, said enabling means enabling said gate sensor means whenever the person moves into the vicinity of the crib, said enabling means comprising a first transmitter and said gate sensor means comprising first receiver, said first transmitter transmitting a first signal over the air for receipt by said first receiver, said enabling means further comprising a photoemitter/photodetector for detecting the presence of the person in the vicinity of said enabling means and for causing said transmitter to transmit said first signal, said gate sensor means comprising a microprocessor, said first receiver resetting said microprocessor whenever said first receiver receives said first signal from said first transmitter, said gate sensor means further comprising a switch means for detecting the open or closed condition of the gate, said switch means informing said microprocessor of the condition of the gate, said microprocessor controlling an indication means based on the condition of the gate, and wherein said indication means comprises an illuminator.

22. An apparatus for use with a baby crib having a displaceable gate that can be positioned in an open condition or in a closed condition wherein said apparatus provides an automatic indication to a person of the condition of the gate, said apparatus comprising:

a remotely-located enabling means and a gate sensor means coupled to the crib, said enabling means enabling said gate sensor means whenever the person moves into the vicinity of the crib, said enabling means comprising a first transmitter and said gate sensor means comprising first receiver, said first transmitter transmitting a first signal over the air for receipt by said first receiver, said enabling means further comprising a photoemitter/photodetector for detecting the presence of the person in the vicinity of said enabling means and for causing said transmitter to transmit said first signal, said gate sensor means comprising a microprocessor, said first receiver resetting said microprocessor whenever said first receiver receives said first signal from said first transmitter, said gate sensor means further comprising a switch means for detecting the open or closed condition of the gate, said switch means informing said microprocessor of the condition of the gate, said microprocessor controlling an indication means based on the condition of the gate, and wherein said indication means comprises an annunciator.

* * * * *

UNITED STATES PATENT AND TRADEMARK OFFICE

CERTIFICATE OF CORRECTION

PATENT NO. : 5,629,683

DATED : May 13, 1997

INVENTOR(S) : Cynthia J. Slomowitz and Scott M. Slomowitz

It is certified that error appears in the above-identified patent and that said Letters Patent is hereby corrected as shown below:

Under "Inventors" on the front page of the above-identified patent, the inventors' CURRENT residence should be listed as follows:

-- 33 Maple Lane, Glen Mills, PA 19342 --

Signed and Sealed this

Sixteenth Day of March, 1999

*Attest:*

Q. TODD DICKINSON

*Attesting Officer*

*Acting Commissioner of Patents and Trademarks*